United States Patent [19]

Carlson

[11] 4,100,652

[45] Jul. 18, 1978

[54] GOLF CLUB ANCHOR

[75] Inventor: Fred E. Carlson, New City, N.Y.

[73] Assignee: The Raymond Lee Organization, Inc., New York, N.Y.

[21] Appl. No.: 763,421

[22] Filed: Jan. 28, 1977

[51] Int. Cl.[2] ..... A63B 55/00

[52] U.S. Cl. ..... 24/3 R; 24/81 R; 224/29 B

[58] Field of Search ..... 24/81, 3 R; 224/29 A, 224/29 B, 29 G; 211/89

[56] References Cited

U.S. PATENT DOCUMENTS

| | | | |
|---|---|---|---|
| 853,544 | 5/1907 | Fernald | 24/81 B X |
| 1,745,548 | 2/1930 | Lerner | 24/81 B |
| 2,072,851 | 3/1937 | Bailey | 24/81 B X |
| 2,881,926 | 4/1959 | Spence | 224/29 A |
| 3,010,628 | 11/1961 | Kowalczyk | 224/29 B |

*Primary Examiner*—Werner H. Schroeder
*Attorney, Agent, or Firm*—Howard I. Podell

[57] ABSTRACT

An anchor clip for detachably mounting to the rim of a golf club bag to which the shank of a golf club, in the bag, may be detachably fastened. The clip is in the form of a set of spaced first U-shaped clamp members joined by a common mid-section with a second U-shaped clamp member mounted to the common mid-section along an axis perpendicular to the first clamp members.

2 Claims, 4 Drawing Figures

GOLF CLUB ANCHOR

SUMMARY OF THE INVENTION

My invention is an anchor clip for detachably mounting to the rim of a golf club bag to which the shank of a golf club, in the bag, may be detachably fastened. The clip is in the form of a set of spaced first U-shaped clamp members joined by a common mid-section with a second U-shaped clamp member mounted to the common mid-section along an axis perpendicular to the first clamp members.

The first set of U-shaped clamp members are of a size to fit about and clamp to the rim of a golf club bag with the second U-shaped clamp member of a size to grip the shank of an inverted golf club and hold the club in an erect position.

BRIEF DESCRIPTION OF THE DRAWINGS:

The objects and features of the invention may be understood with reference to the following detailed description of an illustrative embodiment of the invention, taken together with the accompanying drawings in which.

DESCRIPTION OF THE PREFERRED EMBODIMENT

Figure 1:
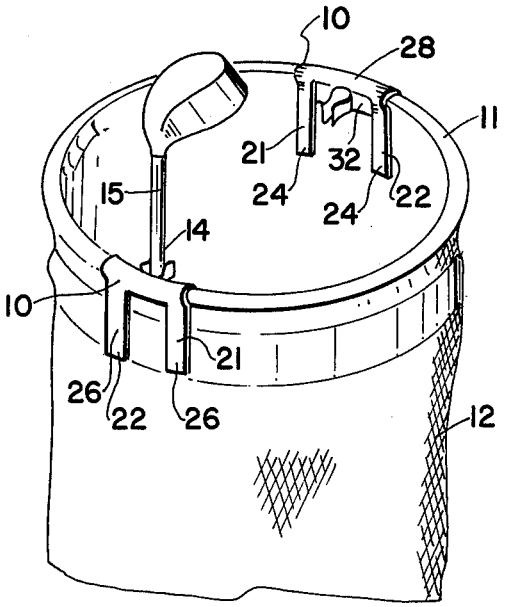
FIG. 1 is a perspective view of the invention in use.
Figure 2:
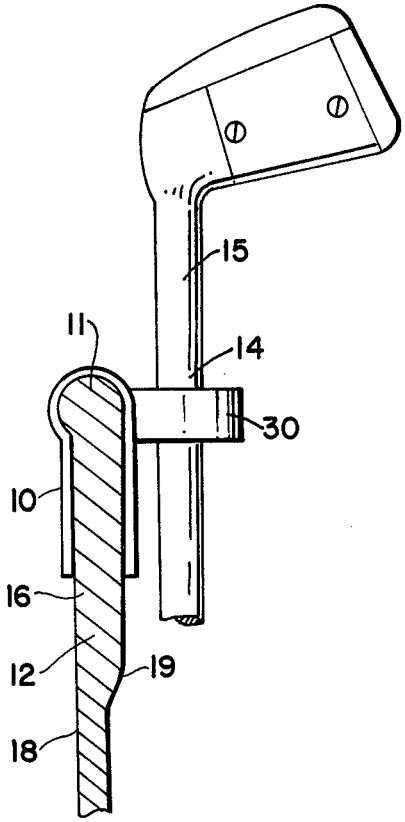
FIG. 2 is a sectional view of the invention in use.
Figure 3:
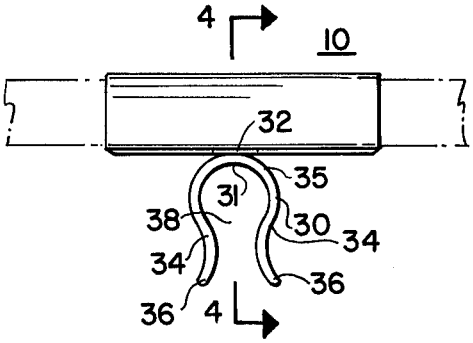
FIG. 3 is a plan view of the invention.
Figure 4:
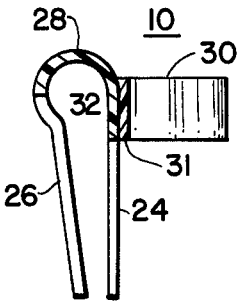
FIG. 4 is a side sectional view of the invention, taken along line 4—4 of FIG. 3.

Turning now descriptively to the drawings, in which similar reference characters denote similar elements throughout the several views, FIGS. 1–4 illustrate the anchor clip 10 clamped about both side surfaces 18, 19 of the rim 11 of a golf club bag 12 with the shank 14 of an inverted golf club 15 detachably clamped in erect position to the wall 16 of the bag 12.

As shown in FIG. 1, a plurality of anchor clips 10 may be fastened to the rim 11 of a bag 12 so as to hold all the golf clubs in erect position and free of interference with each other, as well as assuring ease of selection and removal of an individual golf club.

Clip 10 is formed of a pair of spaced U-sections 21, 22 joined by a common mid-section 28, with each U-section 21, 22 shaped to fit about the rim 11 of a bag 12 and with each U-section formed of an inner leg 24 and an outer leg 26, with the mid-section 28 bent along an arcuate path to follow and fit above the circular rim 11 of bag 12.

A U-shaped clamp clip 30 is fastened at its mid-section 31 to a flange 32 extending from mid-section 28 of the anchor 10, with flange 32 bent to extend about the inside surface 19 of the bag wall 16.

Clip 30 is shaped with S-shaped leg sections 34 each joined to a curved mid-section 35 so that the ends 36 of each leg section 34 are flared away from each other with curved mid-section 35 enclosing an open circular recess 38 of the general diameter of a golf club shank 14.

Preferably, anchor 10 is formed of esilient material so that U-sections 21, 22 will tightly grip the wall of the golf club bag and clamp clip 30 will tightly grip the shank of a golf club held in recess 38.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An anchor clip shaped to detachably fit about the opposed sides of the rim of a golf club bag and formed with a clamp clip of a size to detachably camp about a golf club shank, said clamp clip extending, when the device is installed on a golf club bag, in the radial direction towards the central axis of the attached golf club bag; in which the anchor clip is shaped with a pair of spaced U-shaped members, each said U-shaped member formed of a pair of legs oriented in substantially parallel configuration to each other and to the legs of the other U-shaped member, with both U-shaped members joined to a common mid-section, with the clamp clip shaped as a U-shaped member mounted at its mid-section to the said common mid-section so as to extend along an axis perpendicular to that of the spaced U-shaped members, said anchor clip mid-section bent along an arcuate path so as to follow and fit above a circular rim of a golf club bag when each of the pair of U-shaped members are engaged about the sides of the rim of a said golf club bag.

2. The device as described in claim 1 mounted about the rim of a golf club bag, with the clamp clip extending radially into the opening bounded by said rim and serving as a means for detachably gripping a single golf club so as to separate a said clamped club from any other golf club in the said bag.

* * * * *